US008753699B2

(12) United States Patent
Roberts et al.

(10) Patent No.: US 8,753,699 B2
(45) Date of Patent: Jun. 17, 2014

(54) READY-TO-EAT FOOD TRAY AND METHOD FOR PREPARING THE SAME

(75) Inventors: Iain Roberts, Chicago, IL (US); Eleanor Luna, Chicago, IL (US); George Kyaw Soe Maung Aye, Chicago, IL (US); Jeewon Jung, Cambridge, MA (US); Giancarlo Tedeschi, Parma (IT); Valentina Masotti, Parma (IT); Francesca Passoni, Bannockburn, IL (US)

(73) Assignee: Barilla G. e R. Fratelli S.p.A. (IT)

( * ) Notice: Subject to any disclaimer, the term of this patent is extended or adjusted under 35 U.S.C. 154(b) by 1350 days.

(21) Appl. No.: 12/275,685

(22) Filed: Nov. 21, 2008

(65) Prior Publication Data

US 2009/0186131 A1 Jul. 23, 2009

Related U.S. Application Data

(60) Provisional application No. 61/022,399, filed on Jan. 21, 2008.

(30) Foreign Application Priority Data

Oct. 23, 2008 (EP) ..... 08018554

(51) Int. Cl.
*B65D 77/20* (2006.01)
*B65D 81/32* (2006.01)

(52) U.S. Cl.
USPC ..... 426/114; 426/120; 426/396

(58) Field of Classification Search
USPC ..... 426/106, 108, 110, 112, 113, 114, 115, 426/119, 120, 121, 123, 125, 129, 130, 131
See application file for complete search history.

(56) References Cited

U.S. PATENT DOCUMENTS 2,965,501 A 12/1960 Harriss
3,442,435 A 5/1969 Ludder et al.

(Continued)

FOREIGN PATENT DOCUMENTS

EP 0449643 A1 10/1991
EP 1449643 A1 10/1991

(Continued)

OTHER PUBLICATIONS

Notice of Allowance dated Mar. 29, 2010 issued in related U.S. Appl. No. 12/261,642.

(Continued)

*Primary Examiner* — Humera Sheikh
*Assistant Examiner* — Tynesha McClain-Coleman
(74) *Attorney, Agent, or Firm* — Akerman LLP

(57) ABSTRACT

A sterilized ready-meal food package comprising: a main container, defining a main volume and having a first opening at the upper part; a main food product held inside at least part of such main volume; at least one secondary container defining a secondary volume and having a second opening at the upper part; at least one secondary food product held inside at least part of the secondary volume; removable covering means arranged to occlude the first and the second opening. The main and secondary food products occupy at least 80% of the free volume available therefor; furthermore, the secondary container is associated in a removable manner inside the main container, in such a manner to occupy part of the main volume and reduce the free volume available for the main food product to a portion of the main volume. The finding also comprises a method for preparing the ready-meal food package.

13 Claims, 2 Drawing Sheets

(56) References Cited

U.S. PATENT DOCUMENTS

| | | | | |
|---|---|---|---|---|
| 3,819,080 | A | 6/1974 | Bird | |
| 4,318,935 | A * | 3/1982 | Stussi | 426/576 |
| 4,803,088 | A * | 2/1989 | Yamamoto et al. | 426/107 |
| 4,848,579 | A | 7/1989 | Barnes et al. | |
| D304,658 | S | 11/1989 | Mattei | |
| 4,916,280 | A | 4/1990 | Havette | |
| 4,925,684 | A | 5/1990 | Simon | |
| D312,189 | S | 11/1990 | Noel | |
| 5,315,083 | A | 5/1994 | Green | |
| 5,441,707 | A | 8/1995 | Lewis et al. | |
| D408,686 | S | 4/1999 | Lillelund et al. | |
| D568,111 | S | 5/2008 | Epstein | |
| D607,275 | S | 1/2010 | Griffith | |
| 2007/0092610 | A1 * | 4/2007 | Mize, Jr. | 426/120 |
| 2007/0116806 | A1 | 5/2007 | Parsons | |
| 2007/0116807 | A1 | 5/2007 | Parsons | |
| 2008/0210686 | A1 | 9/2008 | Shapiro et al. | |
| 2009/0022858 | A1 | 1/2009 | Pawlick | |
| 2009/0142455 | A1 | 6/2009 | Parsons | |
| 2009/0186131 | A1 | 7/2009 | Roberts et al. | |
| 2010/0015293 | A1 | 1/2010 | Shapiro et al. | |

FOREIGN PATENT DOCUMENTS

| | | | |
|---|---|---|---|
| FR | 2855817 | A1 | 10/2004 |
| FR | 2892368 | A1 | 4/2007 |
| FR | 2892388 | A1 | 4/2007 |
| GB | 2242410 | A | 10/1991 |

OTHER PUBLICATIONS

Office Action dated Jul. 21, 2009 issued in related U.S. Appl. No. 12/261,642.

* cited by examiner

READY-TO-EAT FOOD TRAY AND METHOD FOR PREPARING THE SAME

FIELD OF APPLICATION

The present invention refers to a ready meal package, and in particular a package of the type heatable in a microwave, comprising at least two separate sterilised food products to be mixed prior to consumption.

Furthermore, the invention refers to a method for preparing a ready-meal package of the abovementioned type.

PRIOR ART

In order to meet the needs regarding limited availability of time for a large share of consumers, the industrial field in question produces and sells various types of food products ready for consumption, in most cases heatable in microwaves. Such products are usually referred to as "ready to heat" or "ready to eat" (depending on whether such ready meals require heating in a microwave).

Among the various types of ready meals, some comprises two separate food components to be mixed before consumption. Generally, one of such components has a liquid or semi-liquid consistency and it serves as a condiment for the other. The two components, for example, can be made up of pasta and a sauce to be mixed therewith or by cereals and condiment cream for the former.

Ready-meals packages of the aforementioned type currently available in the market usually have a tray, partitioned into two compartments holding the separate components and covered by a protection film.

A package of this type usually allows sterilising the food products after package. As a matter of fact, the physical separation of the two components prevents the passage of humidity towards the non-liquid part, preventing deterioration of its organoleptic properties.

However, in order to prevent the sterilisation from deteriorating the quality of food products, limiting the free volume present between the latter and the upper protection film, i.e. minimising the so-called "headspace", is of fundamental importance. This package need turns into a drawback of the described solution. As a matter of fact, in order to meet the headspace requirements, the two compartments of the tray are filled with the products to the brim, and there is absolutely no free space sufficient to mix the two components. Therefore, the consumer is forced to pour the two products into a separate plate, hence leading to unease due to the need of finding and washing such supplementary dishes.

Alternative package solutions, intended to solve the abovementioned problem, provide for the use of a tray, without compartments, into which the two components are premixed. However, in such case, the sterilisation-performed on the non-separated products, risks prejudicing the quality of the food.

An alternative solution employs separate packets for the two components and a rigid container for mixing and consumption; however, the production and package costs in this case increase considerably.

The French patent FR 2855817 describes a tray for package salads, not made to be heated in a microwave, such tray comprising a container nested therein and removable for a corresponding sauce. The removal of the container allows freeing the internal volume of the tray allowing better mixing of the product. On the other hand, the finding refers to a package for salads, and not for ready-meals to be sterilised in an autoclave. Thus, the problem regarding reduction of the headspace is not tackled in the patent.

SUMMARY OF THE INVENTION

Therefore, the technical problem on which the present invention is based is that of providing a sterilised ready-meal package comprising at least two separate food products but easily mixable inside the package, simultaneously capable of preserving the organoleptic characteristics of the two products even after sterilising the package.

The abovementioned technical problem is solved by a ready-meal package according to claim 1, and by a method for preparing a ready-meal package according to claim 12.

The dependent claims outline the preferred and particularly advantageous embodiments of the product and the method of the invention respectively.

Substantially, the idea on which the present invention is based is that of employing, in a sterilised ready-meal package, a secondary container which may be removed to leave a volume for mixing, in a manner similar to the one provided for in the aforementioned patent FR 2855817, thus overcoming the technical drawback oft reducing the headspace.

An advantage of the invention lies in the extreme simplicity and in the low manufacturing costs of the package.

Another advantage of the invention derives from the easy manipulation, of the elements making up the package of the finding, during the step of introducing into the microwave and mixing the food products held therein.

A further advantage of the invention concerns the possibility of heating the package according to the finding in a microwave without deteriorating the organoleptic qualities of the food products of which it is made up.

Further characteristics and advantages shall be clearer from the detailed description, outlined hereinafter, of a preferred but not exclusive embodiment of the present finding, with reference to the attached figures provided for exemplifying and non-limiting purposes.

DETAILED DESCRIPTION

Figure 1:
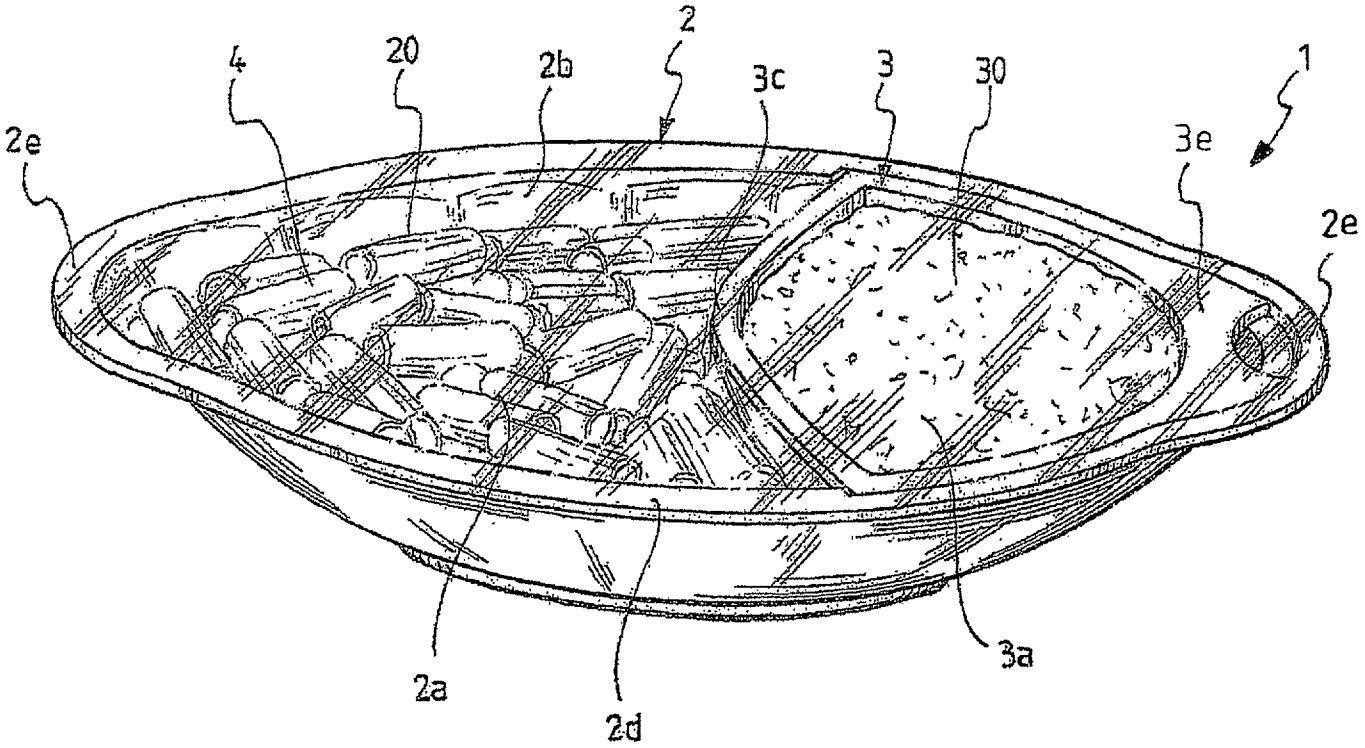
FIG. 1 is a perspective view of an embodiment of the package according to the present finding.
Figure 2:
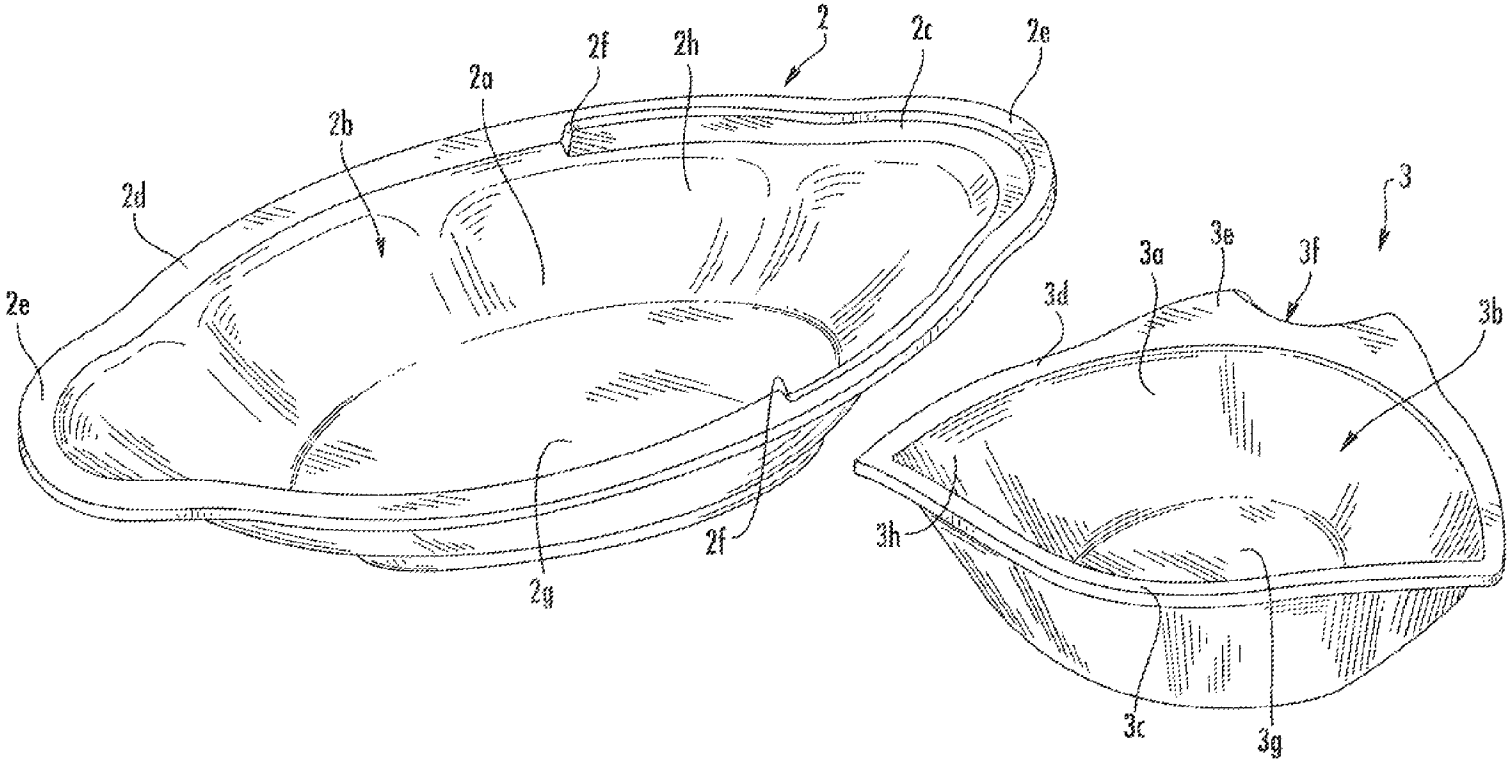
FIG. 2 is a perspective view of a main container and a secondary container making up the package of FIG. 1 separated from each other.

Referring to the attached figures, identified with reference number 1 is a sterilised ready-meal package.

Preferably, the package 1 is of the type made to be heated in a microwave.

The package 1 comprises: a main container 2, defining a main volume 2*a* and having, at the upper part, a first opening 2*b*; a main food product 20 held inside at least part of said main volume 2*a*; at least one secondary container 3, defining a secondary volume 3*a* and having, at the upper part, a second opening 3*b*; at least one secondary food product 30, held inside at least part of said secondary volume 3*a*; removable covering means 4 arranged to occlude said, first and second opening 2*b*, 3*b*.

The main food product 20 can, for exemplification purposes, be made up of pasta, rice or other cereals; the secondary food product 30, still for exemplification purposes, can be a sauce, a vegetable cream or other similar condiments. Such secondary food product 30 preferably has a liquid or semi-liquid consistency. On the other hand, alternative embodiments of the present invention may provide for a main food product 20 of the liquid type with a secondary food product 30 having a solid consistency, or both products may be liquid or solid.

The main and secondary food products 20, 30, for reasons linked to minimising the headspace outlined above, occupy at least 80% of the available free volume.

In the present description, the term free volume is used to indicate the volume inside the container available to be occupied by a product, delimited at the upper part by a plane lying on the opening before sterilisation.

The secondary container 3 is associated in a removable manner inside the main container 2, in such a manner to occupy part of the main volume 2*a* and reduce the free volume available for the main food product 20 to a portion of said main volume 2*a*.

Now, following is a detailed description of the preferred embodiment of the package 1.

The main container 2 and the secondary container 3 respectively comprise a first bottom wall 2*g* and a second bottom wall 3*g*. Such walls 2*g*, 3*g* are preferably planar in such a manner to serve as support bases for the two containers 2, 3. Preferably, the second bottom wall 3*g* lies on the first bottom wall 2*g* when the second container 3 is associated to the first container 2. In the preferred embodiment, the first bottom wall 2*g* has an elliptical contour, while the second bottom wall 3*g* defines an ellipse portion.

The main container 2 comprises a first edge 2*d* developing along the periphery of the first opening 2*b* and the secondary container 3 comprises a second edge 3*d* developing along the periphery of the second opening 3*b*. When the package 1 is closed, the first and the second edge 2*d*, 3*d* are coplanar and in direct contact with the covering means 4, which are integrally associated at least to the first one of them, but preferably to both.

The edges 2*d*, 3*d* are joined to the corresponding bottom walls 2*g*, 3*g* by means of respective side walls 2*h*, 3*h*, preferably inclined and not vertical to facilitate the insertion of the second container 3 into the first 2. The edges 2*d*, 3*d* develop externally projecting with respect to the rest of the containers of which they are part, and in particular projecting with respect to the side walls 2*h*, 3*h*.

In order to constrain the position of the secondary container 3 with respect to the main container 2 holding it, such secondary container 3 is accommodated in a shape-coupled manner inside the main container 2 in a predefined zone of the latter.

The first edge 2*d* of the main container 2 of the package 1 bears, for the purpose, a groove 2*c* at such predefined zone of the main container 2, intended to accommodate the secondary container 3 and maintain it at a predefined position. The groove 2*c*, which develops internally along the first edge 2*d*, accommodates and supports the outer portion of at least part of the second edge 2*d* in such a manner that the first and the second edge 2*d*, 3*d* are coplanar as described above. The groove 2*c* advantageously has two vertical abutment surfaces 2*f* which prevent the secondary container 3 from sliding towards the centre of the main container 2. Alternative embodiments may provide for alternative solutions to prevent such relative sliding.

The secondary container 3 has, on the periphery of the second opening 3*a*, a spout 3*c* adapted to facilitate the pouring of the secondary food product 30 into the main container 2. In the preferred embodiment, the spout 3*c* is defined by a concave trend of the peripheral profile of the second opening 3*b*.

Furthermore, the second edge 3*d* comprises, preferably opposite to such spout 3*c*, a holding strip 3*e*, which has a greater projecting thickness with respect to the rest of the second edge 3*d*. The holding strip 3*e*, as will be better understood from the following description, facilitates grasping the secondary container 3, in particular providing a holding point far from the secondary food product 30 when it reaches a temperature such to prevent its direct manipulation.

In particular, the holding strip 3*e* is at least partially accommodated in the groove 2*c*. The accommodated portion of the strip 3*e* has a peripheral profile which has a recess slope 3*f*. Such peripheral profile, when the two containers are associated, is adjacent to a side surface of the groove 2*c* and it is far from the latter right at the recess slope 3*f*. Such recess has a shape and size adapted to allow the introduction of a finger of a consumer between the peripheral profile and the side surface of the groove 2*c*; the purpose of such distinctive morphological characteristic shall be clearer further ahead in the present description.

In this case, as observable in the attached figures, the main container 2, has a longitudinal extension and comprises, at its opposite ends, two shaped projections 2*e* adapted to facilitate its holding. The groove 2*c*, which defines the position of the secondary container 3, is advantageously arranged at one of such shaped projections 2*e*; hence, the abutment surfaces 2*f* are transverse to the development of the main container.

In the preferred embodiment, the covering means 4 are made up of a single protective film preferably, but not necessary, made of plastic material covering both containers 2, 3.

The materials used for producing the main container 2, the secondary container 3 and the covering means 4 are all preferably specifically intended to be introduced into an operating microwave, without deteriorating the organoleptic qualities of the food products held therein. In particular, they are preferably made of plastic material suitable for use in microwaves.

To emphasise the comfort of using the abovementioned package 1 for the end consumer, following are the operations performed by the latter when consuming.

First and foremost, the user provides for, if necessary, heating or cooking the contents of the package 1, preferably in a microwave.

Preliminarily, depending on the type of food products 20, 30 present, the consumer has the possibility to choose whether to remove or perforate the covering means 4 or not; furthermore, addition of water into the main volume 2*a* or into the secondary volume 3*a* might be required.

Upon heating the package 1, or even prior to introducing it into the oven, the consumer mixes the two food products 20, 30. At this stage, the consumer introduces a finger at the recess slope 3*f*, grasps the holding strip 3*e* and removes the secondary container 3 from the main container 2. Consequently, the main food product 20 is distributed over the entire main volume 2*a*, entirely available at this point.

Then, inclining the secondary container 3, the consumer—through the spout 3—pours the secondary food product 30 into such main volume 2*a*, where the consumer can easily mix and consume the food prepared.

Also an object of the present invention is a method for preparing a sterilised ready-meal food package 1.

The method comprises the following steps: providing a main container 2 defining a main volume 2*a* intended to accommodate a main food product 20, and having an opening 2*b* at the upper part; providing at least one secondary container 3 defining a secondary volume 3*a* and having a secondary opening 3*b* at the upper part; introducing at least one secondary food product 30 into the secondary volume 3*a* at amounts such to occupy at least 80% of an available free volume; introducing said secondary container 3 into the main container 2; introducing a main food product 20 into the main volume 2*a* at amounts such to occupy at least 80% of the free volume left available in the main container 2 after the introduction of the secondary container; applying removable covering means 4 to occlude said first and second opening 2*b*, 3*b*. As observable from the description of the method outlined above, such method comprises—in order to attain the aforementioned subject of the finding—the step of introducing the secondary container 3 into the main container 2. The step of introducing the main food product 20 into the main volume 2*a* is subsequent to such step of introducing the secondary container 3, in such a manner that the free volume available for the main food product 20 in this step is reduced by the presence of the secondary container 3 to a portion of the main volume 2*a*.

Furthermore, the method comprises a step of sterilising—in autoclave—the ready-meal package 1, subsequent to the steps of introducing main and secondary food products. This step, as argued beforehand, makes the reduction of the headspace a fundamental requirement when preparing the package 1.

As observable from the abovementioned description of the package 1 according to the present invention, the step of applying covering means 4 advantageously comprises a step of spreading a film over the first and second opening 2*b*, 3*b* and a step for fixing such film to a first edge 2*d* developing along the periphery of the first opening 2*b* and a second edge 3*d* extending along the periphery of the second opening 2*b*.

The film delimits the entire free volume available for the food products held in the container at the upper part. In practice, occupying at least 80% of the free volume of the two containers, there remains a headspace comprised between the upper level of the food product and the covering means 4 not exceeding 10% of such free volume.

Furthermore, as understandable from the description outlined above, the step of introducing the secondary container 3 into the main container 2 provides for accommodating at least part of the secondary container 3 into a groove 2*c* present on the main container 2.

The implementation of the method outlined above allows preparing a ready-meal food package 1 having the aforedescribed characteristics.

Obviously, the aforedescribed finding may be subjected to numerous modifications and variants—by a man skilled in the art with the aim of meeting the possible and specific requirements—all falling within the scope of protection of the invention as defined by the following claims.

The invention claimed is:

1. A sterilized ready-meal package, comprising:

a main container, defining a main volume and having a first opening at an upper part thereof, said first opening being surrounded by a first edge;

a main food product held inside at least part of said main volume;

at least one secondary container defining a secondary volume and having a second opening at an upper part thereof, said second opening being surrounded by a second edge, said secondary container being associated in a removable manner inside the main container, in such a manner to occupy part of the main volume and reduce the free volume available for the main food product to a remaining portion of said main volume, such that said remaining portion of the main volume and said secondary volume are positioned horizontally, side-by-side;

at least one secondary food product, held inside at least part of said secondary volume;

the secondary container extending all the way down to the bottom of the main container, so that the main food product and the secondary food product are entirely positioned side-by-side on a same horizontal level, not above and below each other;

said main and secondary containers being suitable for containing said main and secondary food products during a heat sterilization process, said main and secondary food products occupying at least 80% of the respective free volume available for the respective products, and removable covering means arranged to occlude both of said first and second openings, the covering means made up of a single protective film covering both containers, the film being fixed to both the first edge and the second edge, wherein the removable secondary container can be removed and the secondary food product poured onto the main food product for mixing therewith in the main container.

2. The ready-meal package according to claim 1, wherein the secondary food product has a liquid or semi-liquid consistency and the secondary container has, on the periphery of the second opening, a spout adapted to facilitate the pouring of the secondary food product into the main container.

3. The ready-meal package according to claim 1, wherein said secondary container is accommodated by means of shape-coupling inside the main container in a predefined zone of the latter.

4. The ready-meal package according to claim 3, wherein the first edge develops along the periphery of the first opening and bearing a groove at said predefined zone, intended to accommodate the secondary container, and the second edge develops, projecting externally with respect to the rest of the secondary container, along the periphery of the second opening; said second edge being received in said groove, in such a manner that said first and second edge are coplanar.

5. The ready-meal package according to claim 4, wherein the second edge comprises a holding strip, having a greater protruding thickness with respect to the rest of the second edge.

6. The ready-meal package according to claim 5, wherein the secondary food product has a liquid or semi-liquid consistency and the secondary container has, on the periphery of the second opening, a spout adapted to facilitate the pouring of the secondary food product into the main container, the holding strip being opposite to the spout.

7. The ready-meal package according to claim 5, wherein the holding strip is at least partially accommodated in the groove, the accommodated portion of the strip having a peripheral profile having a slope recess, said peripheral profile being adjacent to a side surface of said groove and being far therefrom at the slope recess, said slope recess having a shape and size suitable to allow the introduction of a finger of the consumer between the peripheral profile and the side surface of the groove.

8. The ready-meal package according to claim 1, wherein the main container has a longitudinal extension and comprises, at its opposite ends, two shaped projections adapted to facilitate holding.

9. The ready-meal package according to claim 1, wherein the main container, the secondary container and the covering means are made of material specifically intended for use in microwaves.

10. The ready-meal package according to claim 1, wherein said main food product is made up of pasta or rice and said secondary food product is made up of a sauce or cream.

11. A method for preparing a sterilized ready-meal food package comprising the steps of:

providing a main container defining a main volume intended to accommodate a main food product, and having a first opening at an upper part thereof;

providing at least one secondary container defining a secondary volume and having a second opening at an upper part thereof;

introducing at least one secondary food product into the secondary volume in such amounts to occupy at least 80% of a free volume available therefor;

introducing said secondary container into the main container, said secondary container extending all the way down to the bottom of the main container, in such a manner that a free volume, left available in the main container after introducing the secondary container, and said secondary volume are positioned horizontally, side-by-side;

introducing a main food product into the main volume at such amounts to occupy at least 80% of the free volume left available in the main container after introducing the secondary container, said main food product and secondary food product being entirely positioned side-by side on a same horizontal level, not above and below each other;

applying removable covering means to occlude both of said first and second openings, said step comprising a step of spreading a film over said first and second opening and a step of fixing said film to a first edge developing along the periphery of the first opening and a second edge developing along the periphery of the second opening; and sterilizing, by heat, the ready-meal package after the introduction of the main and secondary food products and the application of the removable covering means.

12. The method according to claim 11, wherein the step of introducing the secondary container into the main container provides for accommodating at least part of the secondary container in a groove present on the main container.

13. A sterilized ready-meal package, comprising:

a main container, defining a main volume, having a first opening at an upper part thereof and having a first bottom wall at a lower part thereof, said first opening being surrounded by a first edge;

a main food product held inside at least part of said main volume;

at least one secondary container defining a secondary volume, having a second opening at an upper part thereof and having a second bottom wall at a lower part thereof, said second opening being surrounded by a second edge, said secondary container being associated in a removable manner inside the main container in such a manner to occupy part of the main volume and reduce the free volume available for the main food product to a remaining portion of said main volume, such that said remaining portion of the main volume and said secondary volume are positioned horizontally side-by-side; at least one secondary food product, held inside at least part of said secondary volume;

wherein said second bottom wall lies on the first bottom wall, said main and secondary containers being suitable for containing said main and secondary food products during a heat sterilization process, said main and secondary food products occupying at least 80% of the respective free volume available for the respective products, and removable covering means arranged to occlude both of said first and second openings, the covering means made up of a single protective film covering both containers, the film being fixed to both the first edge and the second edge, wherein the removable secondary container can be removed and the secondary food product poured onto the main food product for mixing therewith in the main container.

* * * * *